US005756166A

United States Patent [19]

Shinohara

[11] Patent Number: 5,756,166

[45] Date of Patent: May 26, 1998

[54] ARTIFICIAL FLOWER WITH WATER INDUCED COLOR CHANGE

[75] Inventor: Hiroki Shinohara, Matsudo, Japan

[73] Assignee: Takara Co., Ltd., Tokyo, Japan

[21] Appl. No.: 595,407

[22] Filed: Feb. 5, 1996

[30] Foreign Application Priority Data

Feb. 7, 1995 [JP] Japan ..... 7-042498

[51] Int. Cl.[6] ..... A41G 1/00

[52] U.S. Cl. ..... 428/24; 156/61; 428/26

[58] Field of Search ..... 428/24, 26; 156/61

[56] References Cited

U.S. PATENT DOCUMENTS

| | | | |
|---|---|---|---|
| 4,810,562 | 3/1989 | Okawa et al. | 428/29 X |
| 4,888,219 | 12/1989 | Barnes | 428/26 X |
| 5,077,102 | 12/1991 | Chong | 428/24 |
| 5,079,049 | 1/1992 | Kito et al. | 428/24 |
| 5,120,583 | 6/1992 | Garcia | 428/24 |

FOREIGN PATENT DOCUMENTS

| | | | |
|---|---|---|---|
| 1600027 | 10/1981 | United Kingdom | 428/24 |

*Primary Examiner*—Henry F. Epstein
*Attorney, Agent, or Firm*—Price, Gess & Ubell

[57] ABSTRACT

An artificial flower capable of exhibiting, with a lapse of time, a variation in color development sufficient to provide a user with visual pleasure as in a natural flower. The artificial flower includes a stem formed into an appearance like a stalk and and the like and constructed so as to suck up water by a capillary action, a receiver formed into an appearance like a receptacle and the like and constructed so as to permit an upper end of the stem to be upwardly inserted therethrough, a corolla section made of a material which exhibits a capillary action when it is wetted, a water-soluble pigment arranged at a central portion of the corolla section, and a holder adapted to be forcedly inserted into the receiver at the central portion of the corolla section, resulting in fixing the central portion of the corolla section in the receiver while keeping the central portion in contact with the upper end of the stem.

13 Claims, 5 Drawing Sheets

ARTIFICIAL FLOWER WITH WATER INDUCED COLOR CHANGE

BACKGROUND OF THE INVENTION

1. Field of the Invention

This invention relates to an artificial flower, and more particularly to an artificial flower adapted to develop color when it is fed with water.

2. Description of Related Art

A conventional artificial flower which is adapted to carry out color development when it is fed with water is generally classified into two groups. An artificial flower of one of the groups is made of a white material exhibiting a capillary action. When the artificial flower thus formed is put in a vessel in which water colored with a pigment is stored, water containing the pigment is allowed to permeate a corolla section of the artificial flower through a stem thereof by a capillary action, resulting in the corolla section carrying out color development. An artificial flower of the other group is made of a material likewise exhibiting a capillary action and having a pigment adhered thereto, which is adapted to carry out color development upon feed of water thereto. When the artificial flower is placed in a pot in which water is stored, the water is permitted to penetrate a stem and a corolla section by a capillary action, resulting in the artificial flower carrying out color development.

Unfortunately, the former conventional artificial flower requires to feed water colored with a pigment thereto, so that much time and labor are required for purchase, storage and handling of the pigment and mixing of the pigment with water in a predetermined ratio. Also, it fails to permit the corolla section to develop plural kinds of color. Further, it causes a useless part of the pigment to exist between the stem and the corolla section, leading to economical loss.

The latter conventional artificial flower permits ordinary water to be used for color development, however, color development taking place in the artificial flower is limited to a color of the pigment. Also, it causes a shading of color developed to be fixed at the time when the pigment is adhered to the artificial flower, so that it is substantially impossible to variably set the shading as desired. Further, it causes a whole pigment-adhered portion of the artificial flower to concurrently carry out color development, to thereby fail to exhibit a variation in color development with a lapse of time.

Thus, it will be noted that the prior art fails to exhibit a variation in color development sufficient to provide a user with such visual pleasure as encountered with a natural flower.

SUMMARY OF THE INVENTION

The present invention has been made in view of the foregoing disadvantage of the prior art.

Accordingly, it is an object of the present invention to provide an artificial flower which is capable of varying a site of color development in the artificial flower and an area thereof with a lapse of time after feed of water thereto, resulting in exhibiting a variation in color development sufficient to provide a user with visual pleasure as in a natural flower.

In accordance with the present invention, an artificial flower is provided. The artificial flower includes a receiver formed into an appearance like at least one of a receptacle and a calyx and constructed so as to receive a predetermined amount of water therein, a corolla section made of a material which exhibits a capillary action when it is wetted, a water-soluble pigment arranged at a central portion of the corolla section, and a holder adapted to be forcedly inserted into the receiver from above the corolla section at the central portion of the corolla section while being aligned with the central portion of the corolla section, resulting in fixing the central portion of the corolla section in the receiver while keeping the central portion in contact with water received in the receiver.

In a preferred embodiment of the present invention, the receiver includes a lid arranged thereon so as to sealedly cover the receiver and which is ruptured by the holder when the holder is inserted into the receiver and the holder includes a pin to be forcedly inserted through the central portion of the corolla section, wherein the pin of the holder is capable of rupturing the lid to permit water to permeate the corolla section.

In a preferred embodiment of the present invention, the water-soluble pigment is carried on a pigment carrier made of a water permeable material.

In a preferred embodiment of the present invention, the water-soluble pigment is carried on the central portion of the corolla section.

Also, in accordance with the present invention, an artificial flower is provided. The artificial flower includes a stem formed into an appearance like at least one of a stalk and a peduncle and constructed so as to suck up water therethrough by a capillary action, a receiver formed into an appearance like at least one of a receptacle and a calyx and constructed so as to permit an upper end of the stem to be upwardly inserted therethrough, a corolla section made of a material which exhibits a capillary action when it is wetted, a water-soluble pigment arranged at a central portion of the corolla section, and a holder forcedly inserted into the receiver from above the corolla section at the central portion of the corolla section while being aligned with the central portion of the corolla section, resulting in fixing the central portion of the corolla section in the receiver while keeping the central portion in contact with the upper end of the stem.

In the artificial flower of the present invention thus constructed, when the holder is inserted through the central portion of each of the pigment carrier and corolla section and then securely fitted in the receiver, water stored in the receiver is permitted to penetrate the pigment carrier and corolla section, so that the pigment may be dissolved in the water and then transferred toward a distal end of the corolla section, resulting in color development taking place in the corolla section.

When a pot or a vase in which the artificial flower is put is fed with water, water is transferred through the stem to the corolla section by a capillary action with a lapse of time, so that the pigment may be dissolved in the water, leading to color development.

A speed of color development in the corolla section, a site of the color development, an area of the color development or a shading of color developed is varied depending on the amount of water fed from the stem to the corolla section and the amount of pigment dissolved in the water.

When the water-soluble pigment is carried on the water permeable material such as a non-woven fabric, a felt or the like, a selective combination of the corolla section of a desired shape and the pigment carrier permits the artificial flower to be provided with both desired configuration and color.

When the pigment is carried on the central portion of the corolla section itself, the pigment is permitted to be rapidly diffused by water transferred from the stem to the corolla section by a capillary action, leading to color development in the artificial flower.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
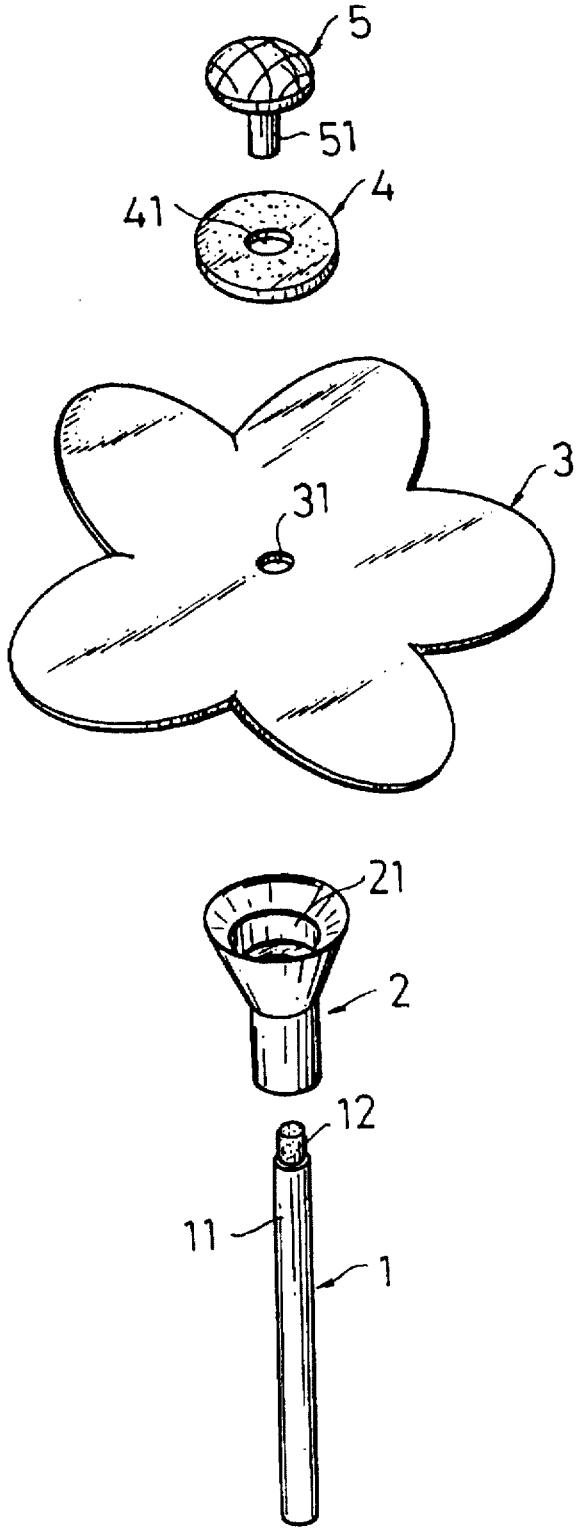
FIG. 1 is an exploded perspective view showing an embodiment of an artificial flower according to the present invention.

Now, an artificial flower according to the present invention will be detailedly described hereinafter with reference to the accompanying drawings.

Referring first to FIGS. 1 to 4, an embodiment of an artificial flower according to the present invention is illustrated. An artificial flower of the illustrated embodiment generally includes a stem 1, a receiver 2, a corolla section 3, a pigment carrier 4 and a holder 5.

The stem 1 is formed so as to exhibit an appearance like a stalk of a natural flower and/or a peduncle thereof and constructed so as to exhibit a capillary action sufficient to permit the stem 1 to suck up water to feed it to an upper end thereof when a lower portion of the stem 1 is immersed in water. For this purpose, the stem 1 includes an elongated hollow cylinder 11 and a core material 12 arranged in the cylinder 11 so as to suck up water due to a capillary action when it is wetted. The core material 12 may be formed by winding a tissue paper into a cylindrical or rod-like shape. Alternatively, it may comprise a cotton swab or a bar-like felt. The core member 12 is arranged in a manner to slightly project at an upper portion thereof from an upper end of the cylinder 11.

In such arrangement of the stem 1 wherein the cylinder 11 covers the core member 12, coloring of the cylinder 11 substantially identical with that of a stalk of a natural flower permits the cylinder 11 to exhibit an appearance like a natural flower. The above-described construction of the core member 12 causes the member 12 to be inherently somewhat decreased in rigidity or inherently limp, however, covering of the core member 12 with the cylinder 11 significantly reinforces the core member 12. The cylinder 11 may be constructed at at least a part thereof in a longitudinal direction thereof into a bellow-like structure. This permits the stem 1 to be suitably bent as desired, so that the stem 1 may exhibit a variation in appearance as seen in a stalk of a natural flower.

Figure 2:
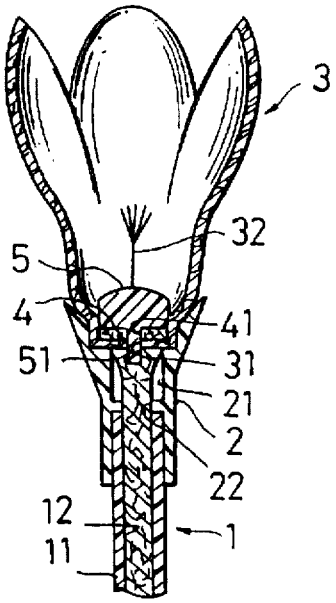
FIG. 2 is a sectional view of the artificial flower shown in FIG. 1.

The receiver 2 is formed into a suitable shape like a dish-like shape, a winecup-like shape or a cylindrical shape so as to exhibit an appearance like a receptacle of a natural flower. The receiver 2 is formed at a central section thereof with a vertically extending through-hole 21, which is formed at an intermediate part thereof with a diameter-reduced portion 22. The above-described stem 1 is forcedly inserted at an upper end thereof into a portion of the through-hole 21 of the receiver 2 defined below the diameter reduced portion 22, resulting in being firmly connected to the stem 1. Such insertion of the stem 1 into the receiver 2 is carried out in such a manner that the upper portion of the core member 12 upwardly extending or projecting from the upper end of the cylinder 11 is arranged so as to extend to an upper region of the through-hole 21 above the diameter-reduced portion 22, as shown in FIG. 2.

At least a part of the upper region of the through-hole 21 is enlarged so as to facilitate insertion of the corolla section 3, holder 5 and the like into the through-hole 21.

The corolla section 3 is made of a material which exhibits a capillary action when it is wetted. The materials include, for example, paper, synthetic paper, fabric, non-woven fabric and the like. The corolla section 3 may be formed into any desired shape like a schizopetalous corolla, a gamopetalous corolla or the like. The corolla section 3 is formed at a central portion thereof with a small through-hole 31.

The pigment carrier 4 is made of a water-permeable material such as, for example, a felt or the like. The material has starch or paste applied thereto, through which a powdery water-soluble coloring agent or pigment is carried on the material, resulting in the pigment carrier 4 being provided. The artificial flower may be often required to exhibit harmless properties depending on a location on which it is to be placed, a user or the like. For this purpose, an edible pigment may be conveniently used. The pigment carrier 4 is likewise formed at a central portion thereof with a small through-hole 41.

The holder 5 acts to securely hold the central portion of the corolla section 3 and the pigment carrier 4 at the upper portion of the through-hole 21 of the receiver 2. For this purpose, the holder 5 includes a pin 51 arranged so as to downwardly extend from a body of the holder 5 and inserted via the through-hole 31 of the corolla section 3 and the through-hole 41 of the pigment carrier 4.

In the artificial flower of the illustrated embodiment constructed as described above, the pin 51 of the holder 5 is inserted via the through-hole 41 of the pigment carrier 4 and the through-hole 31 of the corolla section 3 in order or in reverse order and then forcedly fitted at a distal end thereof in the through-hole 21 of the receiver 2. This results in the distal end of the pin 51 being forcibly inserted into a center of the upper portion of the core member 12 of the stem 1 upwardly projected from the cylinder 11 of the stem 1 as shown in FIG. 2. Also, this causes the holder 5 to forcedly fit the central portion of the corolla section 3 in the upper portion of the through-hole 21 of the receiver 2, so that the central portion of the corolla section 3 and the pigment carrier 4 are fixed in the receiver 2 and the central portion of the corolla section 3 exhibiting a capillary action is brought into contact with the core member 12 of the stem 1 likewise exhibiting a capillary action. Further, the central portion of the corolla section 3 is contracted during fitting of it in the receiver 2, so that the corolla section 3 is possibly formed at a portion thereof in proximity to the receiver 2 with creases or rumples 32. Such creases or rumples 32 permit the corolla section 3 made of a sheet-like monotonous material to be shaded.

Figure 3:
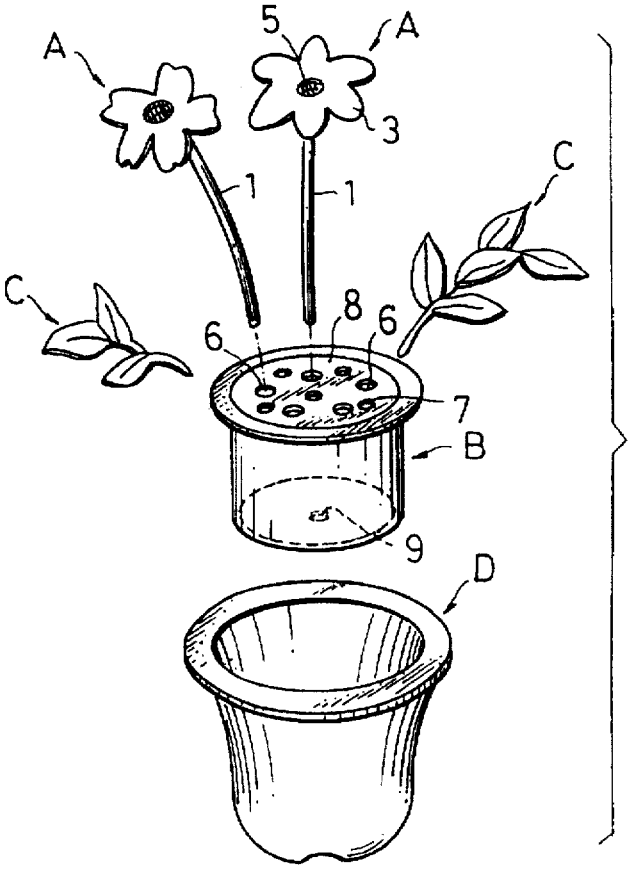
FIG. 3 is an exploded perspective view showing a manner of use of the artificial flower of FIG. 1.

When the artificial flower thus assembled is to be fed with water for color development, the artificial flower A, as shown in FIG. 3, is put in a water feed vessel B while being kept vertical. The water feed vessel B includes a lid 8 formed with a plurality of insertion holes 6 and 7. Also, the water feed vessel B is formed at a bottom thereof with a drain hole 9. The water feed vessel B may have only the artificial flowers A of at least one kind put therein. Alternatively, leaves C as well as the artificial flowers A may be put in the vessel B depending on a kind of the flower.

The water feed vessel B may be received in a pot D. The pot D is not formed with any hole so that water flowing out of the water feed vessel B through the drain hole 9 is held in the pot D. Alternatively, the pot D may be formed at a bottom thereof with vent holes as in a conventional flowerpot. In this instance, a water receiver (not shown) for receiving water flowing out of the water feed vessel B is arranged in the pot D.

Thus, a suitable number of the artificial flowers A or a suitable number of flowers A and leaves C in combination are fixedly put in the water feed vessel B and then the water feed vessel B is put on the water receiver arranged in the pot D. Alternatively, the water feed vessel B is put in the pot D which is not formed at the bottom thereof with any hole. Then, the water feed vessel B is fed with ordinary water (colorless water). This results in water thus collected in the water feed vessel B being sucked up from the lower end of the stem 1 of each of the artificial flowers A through the stem 1 to the upper end of the core member 12 due to a capillary action of the core member 12 arranged in the stem 1.

Figure 4:
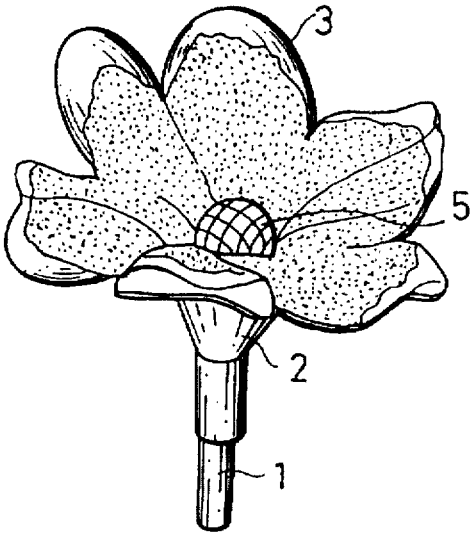
FIG. 4 is a perspective view showing an example of color development in an essential part of the artificial flower of FIG. 1.

The upper end of the core member 12 is kept in contact with the central portion of the corolla section 3 exhibiting a capillary action, so that water guided or sucked up to the upper end of the core member 12 is dispersed in the corolla section 3 while dissolving the water-soluble pigment carried on the pigment carrier 4 arranged at the central portion of the corolla section 3. Water which has thus dissolved the pigment therein is subsequently moved toward a distal end of the corolla section 3 by a capillary action of the corolla section 3, so that the pigment is likewise transferred toward the distal end of the corolla section while being carried on the water, resulting in the corolla section 3 carrying out color development as illustrated in FIG. 4.

Water fed to the water feed vessel B is sucked up by the core member 12. Excessive water exceeding a water suck-up or absorption capacity of the core member 12 is downwardly outwardly discharged through the drain hole 9 of the water feed vessel B. Therefore, a distance by which the pigment dissolved in water is transferred from the pigment carrier 4 toward the distal end of the corolla section 3 or an area of color development in the corolla section 3 is varied depending on a water capacity of the core member 12 of the stem 1, water permeability of the corolla section 3 and an evaporation speed of water from a surface of the corolla section 3. When the amount of water fed is reduced, color development takes place at a region of the corolla section 3 in proximity to the center of the corolla section 3 and an increase in amount of water fed causes the pigment to be transferred to the distal end of the corolla section 3, resulting in the color development region being enlarged from the center of the corolla section toward the distal end thereof. A further increase in water fed to the stem 1 causes the remaining pigment to be transferred to the distal end of the corolla section, resulting in color development which is carried out in the corolla section 3 being limited to only a region thereof in proximity to the distal end of the corolla section 3. This causes the distal end portion of the corolla section to be deep in color, so that color development of the corolla section is carried out in a shading-like manner.

Thus, the amount of water fed to the artificial flower A, a length of the core member 12, a thickness thereof and the like are determined or set in view of such factors as described above.

Figure 5:
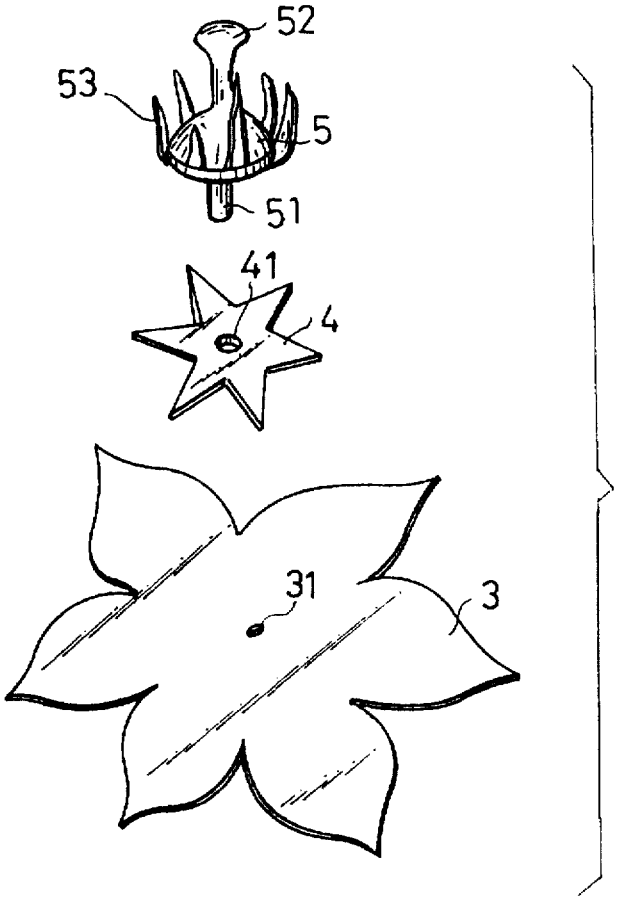
FIG. 5 is an exploded perspective view showing an essential part of another embodiment of an artificial flower according to the present invention.

The holder 5 for securely holding the corolla section 3 and pigment carrier 4 on the stem 1, as shown in FIG. 1, is desirably formed on an upper surface thereof into a configuration exhibiting an appearance like an ovary of a natural flower. Also, in order to permit the artificial flower to further approach a natural flower, the holder 5, as shown in FIG. 5, may be provided on the upper surface thereof and at a periphery of the upper surface thereof with a pistil 52 and stamens 53 in addition to the above-described ovary, respectively.

Figure 6:
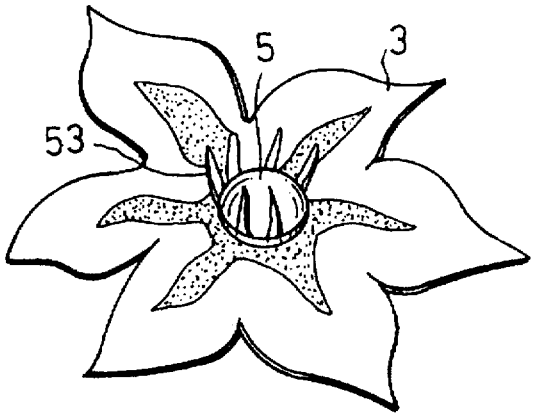
FIG. 6 is a perspective view showing color development in the artificial flower of FIG. 5.

Color development carried out in the corolla section 3 depends on the magnitude of pressing force of the holder 5, as well as a configuration of the pigment carrier 4 and the like. When the pressing force is not so large and the pigment carrier is formed into an annular shape as shown in FIG. 1, the pigment, as shown in FIG. 4, is transferred or dispersed toward the distal end of the corolla section 3 at substantially the same speed over a whole periphery thereof, resulting in color development in the corolla section 3 taking place in a circular manner. On the contrary, when the pigment carrier 4 is formed into a star-like shape in conformity to a configuration of the corolla section 3 as shown in FIG. 5, color development in the corolla section may be carried out along veins of a petal of the corolla section 3 as shown in FIG. 6.

As will be noted from the above, color development in the artificial flower of the present invention is accomplished in principle by dissolving the pigment in water permeating the central portion of the corolla section and dispersing the water toward the distal end of the corolla section while carrying the pigment thereon. The illustrated embodiment, as described above, is so constructed that the pigment is carried on the pigment carrier of water permeable properties arranged separately from the corolla section. Thus, in the illustrated embodiment, a combination of the corolla section of any desired configuration and the pigment carrier containing the pigment of any desired color permits color development to be accomplished in the corolla section as desired. Also, the pigment carrier may be formed into any desired configuration. Further, the pigment carrier may have a plurality of pigments different in color carried thereon in turn in a circumferential direction thereof. This permits petals of the corolla section to exhibit development of colors different from each other.

In order to realize the above-described color development, the pigment may be arranged on the central portion of the corolla section by means of starch or paste. Such arrangement of the pigment on the corolla itself permits the pigment to be rapidly diffused in the petals of the corolla section 3 while being carried on water permeating the central portion of the corolla section, resulting in color development being accomplished at an increased speed. Also, the pigment may be selected depending on a natural flower imagined by a configuration of the corolla section. This permits color development corresponding to the natural flower to be accomplished, so that the artificial flower may be effective as teaching materials for an infant or the like as well.

As described above, when water is fed to a pot or a vase in which the artificial flower of the illustrated embodiment is put, a speed of color development in the corolla section by the pigment, a range of the color development and/or a shade of the color development are varied depending on the amount of water sucked up by the stem, so that the artificial flower of the illustrated embodiment may exhibit highly increased diversity, resulting in being in good taste, as compared with a conventional artificial flower which carries out color development at the same speed and to the same extent.

In the illustrated embodiment, water is sucked up from the lower end of the stem having an appearance like a stalk of a natural flower to the receiver by a capillary action of the stem and then transferred, by a capillary action of the corolla section, toward the distal end of the corolla section through a boundary portion between the corolla section and the stem forcedly inserted together into the receiver. Thus, an area of color development in the corolla section is determined depending on the amount of water fed, a capacity of the stem, an evaporation speed of water in the corolla section and the like. Thus, the illustrated embodiment causes a user of the artificial flower to fail to determine a water feed quantity or rate sufficient to permit a final color development area to be provided as desired.

Figure 7:
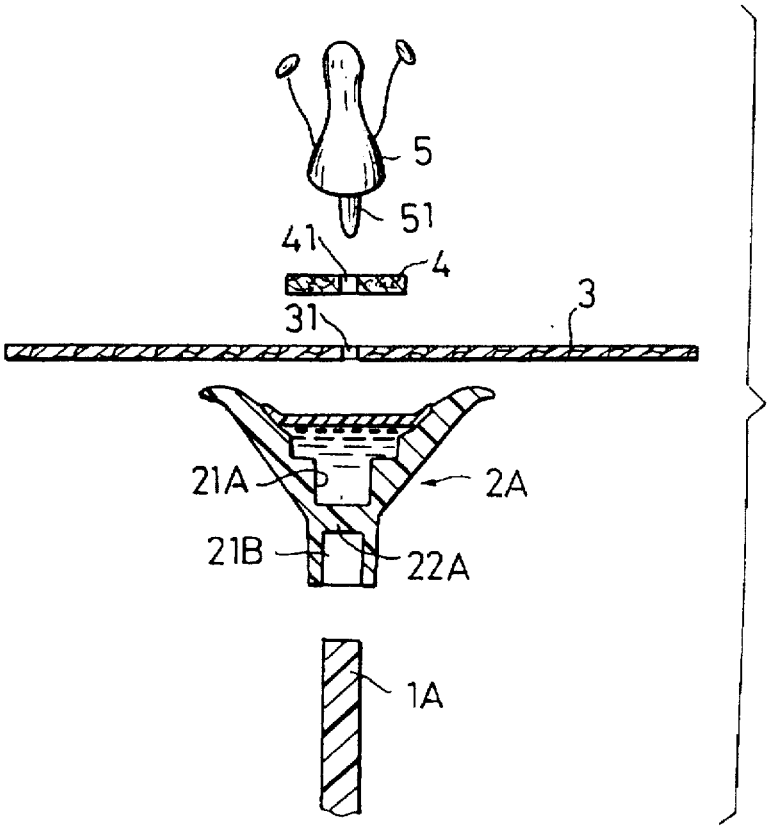
FIG. 7 is an exploded front elevation view in section showing a further embodiment of an artificial flower according to the present invention.
Figure 8:
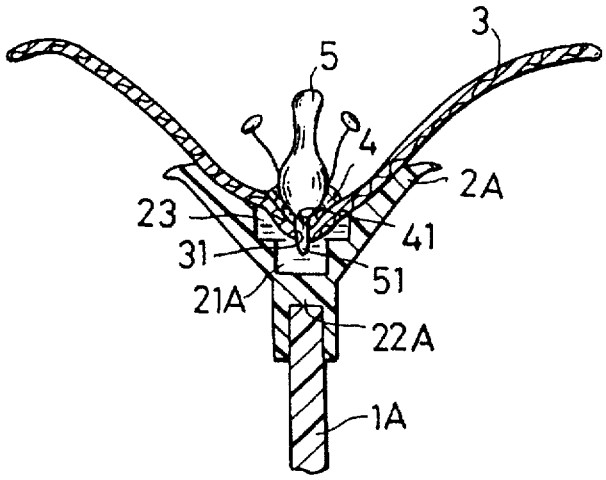
FIG. 8 is a sectional front elevation view of the artificial flower shown in FIG. 7.

Referring now to FIGS. 7 and 8, another embodiment of an artificial flower according to the present invention is illustrated, which is constructed so as to eliminate the above-described disadvantage of the embodiment described above. More particularly, an artificial flower of the illustrated embodiment generally includes a receiver 2A, a corolla section 3, a pigment carrier 4 and a holder 5. A stem 1A is not indispensable for the artificial flower of the illustrated embodiment. More particularly, the stem 1A is not required to function to suck up water therethrough. If the stem 1A is incorporated in the artificial flower, it is merely required to exhibit an appearance like a stalk of a natural flower.

The receiver 2A is formed into a cup-like shape. More particularly, the receiver 2A includes a bottom 22A, on which an upper hole 21A is arranged. The upper hole 21A is adapted to receive water therein and sealedly closed with a breakable or rupturable lid 23. The receiver 2A is also formed with a lower hole 21B in a manner to be arranged under the bottom 22A, into which an upper portion of the stem 1A is forcedly inserted, so that the stem 1A is connected to the receiver 2A. Connection between the receiver 2A and the stem 1A may be carried out in any suitable manner.

The lid 23 is broken or ruptured when a pin 51 of the holder 5 is downwardly inserted via both a through-hole 41 of the pigment carrier 4 and a through-hole 31 of the corolla section 3 and then downwardly forcedly inserted into the receiver 2A.

When the holder 5 is forcedly inserted into the receiver 2A to break the lid 23, water oozing out of the upper hole 21A along the pin 51 of the holder 5 is allowed to penetrate a central portion of the corolla section 3 and then permeate the pigment carrier 4, so that a pigment of the pigment carrier 4 is dissolved in the water and transferred toward a distal end of the corolla section 3 while being carried on the water, resulting in color development being carried out in the corolla section as in the embodiment described above.

The remaining part of the illustrated embodiment may be constructed in substantially the same manner as the above-described embodiment.

In the illustrated embodiment, only water received in the receiver 2A is used for color development carried out in the corolla section. Therefore, when the receiver 2A is formed into a suitable volume or capacity, an area of color development in the corolla section may be relatively readily controlled.

Thus, when the receiver 2A is stored with water in an amount depending on an area of color development in the corolla section desired, the artificial flower of the illustrated embodiment carries out color development over a desired area, resulting in exhibiting much pleasure and interest.

Figure 9:
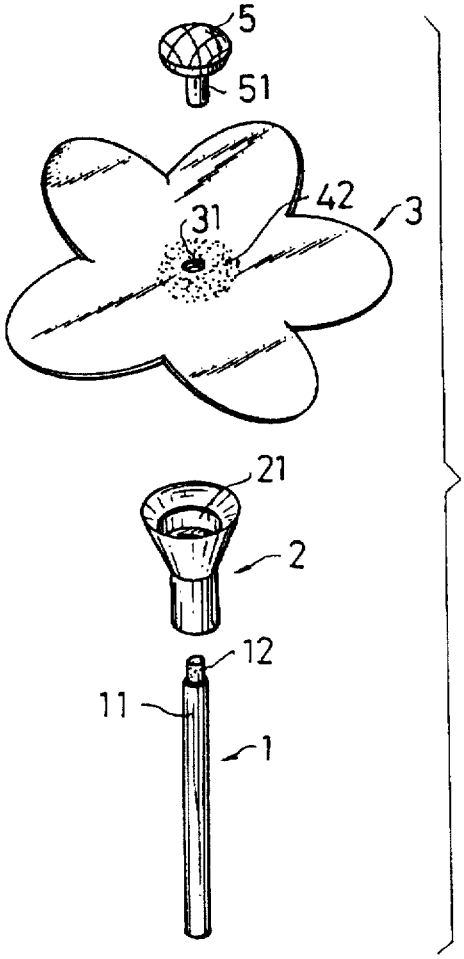
FIG. 9 is an exploded perspective view showing still another embodiment of an artificial flower according to the present invention.

Referring now to FIG. 9, a further embodiment of an artificial flower according to the present invention is illustrated. An artificial flower of the illustrated embodiment is so constructed that a pigment 42 is adhered directly to a corolla section 3, to thereby eliminate arrangement of a pigment carrier. The remaining part of the illustrated embodiment may be constructed in substantially the same manner as the embodiment of FIG. 1.

As can be seen from the foregoing, the artificial flower of the present invention permits a site of color development in the corolla section and an area thereof to be varied with a lapse of time after feed of water thereto, resulting in exhibiting a variation in color development sufficient to provide a user with visual pleasure as in a natural flower.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An artificial flower comprising:

a receiver formed into an appearance resembling at least one of a receptacle and a calyx and constructed so as to receive a predetermined amount of water therein;

a corolla section made of a material which exhibits a capillary action when it is wetted;

a water-soluble color pigment carrier arranged at only a central portion of said corolla section; and a holder adapted to be forcedly inserted into said receiver from above said corolla section at said central portion of said corolla section while being aligned with said central portion of said corolla section, resulting in fixing said central portion of said corolla section in said receiver while keeping said central portion contacted with water received in said receiver to enable the water-soluble color pigment carrier to dissolve the color pigment so that it is transported by capillary action through the corolla section.

2. An artificial flower as defined in claim 1, wherein said receiver includes a lid arranged thereon so as to sealedly cover said receiver and ruptured by said holder when said holder is inserted into said receiver; and said holder includes a pin to be forcedly inserted through said central portion of said corolla section;

said pin of said holder being capable of rupturing said lid to permit water to permeate said corolla section.

3. An artificial flower as defined in claim 2, wherein said water-soluble pigment is carried on a pigment carrier made of a water permeable material.

4. An artificial flower as defined in claim 1, wherein said water-soluble pigment is carried on a pigment carrier made of a water permeable material.

5. An artificial flower comprising:

a stem formed into an appearance resembling at least one of a stalk and a peduncle and constructed so as to suck up water therethrough by a capillary action;

a receiver formed into an appearance resembling at least one of a receptacle and a calyx and constructed so as to permit an upper end of said stem to be upwardly inserted therethrough;

corolla section made of a material which exhibits a capillary action when it is wetted;

a water-soluble color pigment carrier arranged at only a central portion of said corolla section; and a holder forcedly inserted into said receiver from above said corolla section at said central portion of said corolla section while being aligned with said central portion of said corolla section resulting in fixing said central portion of said corolla section in said receiver while keeping said central portion in contact with said upper end of said stem and securing said water-soluble color pigment carrier into contact with said corolla section whereby the capillary action of said corolla section will introduce water to said pigment carrier to dissolve the color pigment and to carry the color pigment to peripheral portions of said corolla section.

6. An artificial flower as defined in claim 5, wherein said water-soluble pigment is carried on a pigment carrier made of a water permeable material.

7. An artificial flower assembly comprising:

a support member having a configuration to simulate a peduncle of a flower;

a receptacle member mounted on the support member and configured to simulate a receptacle of a flower;

a corolla member having a configuration to simulate a corolla of a flower with a central portion and peripheral portions simulating petals of the flower and made of a material which exhibits a capillary action when it is wetted;

pigment means including a detachable member for providing a water-soluble pigment of a predetermined color to permeate through the corolla member from the central portion to the peripheral portions;

means for providing water to the receptacle member; and means for mounting the pigment means directly on the central portion of the corolla member for receiving water from the receptacle member to dissolve the water-soluble pigment to be carried by capillary action to the peripheral portions simulating petals of the flower.

8. An artificial flower assembly as defined in claim 7, wherein the means for providing water includes a hollow cavity in the receptacle member and a frangible lid member sealing the water in the cavity and the means for mounting includes a holder member with a lower pin member for breaking the lid member.

9. An artificial flower assembly as defined in claim 8, wherein the pigment means includes a resilient water permeable disc member impregnated with an edible pigment.

10. An artificial flower assembly as defined in claim 8, wherein the pigment means includes a resilient water permeable member configured to simulate a star-shaped configuration and impregnated with an edible pigment.

11. An artificial flower assembly as defined in claim 7, wherein the support member is hollow and includes a material which exhibits a capillary action when it is wetted and the receptacle member transfers the water to the pigment means.

12. An artificial flower assembly as defined in claim 11, wherein the pigment means includes a resilient water permeable disc member impregnated with an edible pigment.

13. An artificial flower assembly as defined in claim 11, wherein the pigment means includes a resilient water permeable member configured to simulate a star-shaped configuration and impregnated with an edible pigment.

* * * * *